United States Patent [19]

Suzuki

[11] Patent Number: 4,719,931

[45] Date of Patent: Jan. 19, 1988

[54] EYELASH CURLER

[76] Inventor: Kisaburo Suzuki, No. 23-5, 4-chome, Shibamata, Katsushika-ku, Tokyo, Japan

[21] Appl. No.: 934,655

[22] Filed: Nov. 25, 1986

[51] Int. Cl.[4] ..... A45D 2/42

[52] U.S. Cl. ..... 132/32 C; 132/31

[58] Field of Search ..... 132/31–33 R

[56] References Cited

U.S. PATENT DOCUMENTS

| | | | |
|---|---|---|---|
| 1,925,266 | 9/1933 | Manning | 132/31 R |
| 2,022,697 | 12/1935 | Tuttle et al. | 132/32 C |
| 2,506,121 | 5/1950 | Tuttle et al. | 132/32 C |
| 3,838,699 | 10/1974 | Skandalakis | 132/31 A |

*Primary Examiner*—Gregory E. McNeill

*Attorney, Agent, or Firm*—Holman & Stern

[57] ABSTRACT

In known eyelash curlers including upper and lower nipping members the lower one of which is slidable up and down through a link mechanism connected to an manually operated handle and a heating wire fixed on the upper nipping member, the improvement comprising a heater and blower device contained in the gripping body which is to be connected to power source, a flexible tube extending from the blower and a nozzle member connected to the flexible tube and, in a preferred embodiment, having such downward flared configuration as allowing hot air to be evenly distributed all over the outer surface of the upper nipping member.

9 Claims, 11 Drawing Figures

EYELASH CURLER

BACKGROUND OF THE INVENTION

This invention relates to an eyelash curler for beauty treatment. Various eyelash curlers have been proposed, among which the applicant can mention the one disclosed as Japanese Utility Model Publication NO. 57-60721 as the most pertinent prior art to the present invention. It is illustrated as FIGS. 10, 11 in the accompanying drawings. It employs a knowm construction except that one or more dry cell is contained in the gripping body and is connected to the heater or heating wire D which is placed in the gap C between the upper nipping member A and the outer shield B, while, the reference symbol A' represents the inner shield.

However, with this construction, since the heater is naturally limited in length, it can not promptly produce such sufficient heat as enabling satisfactory curling of the eyelash. Thus, there have been involved such disadvantages that it takes much time and the eyelash once curled is apt to return to the original uncurled state.

SUMMARY OF THE INVENTION

Accordingly, it is an object of the present invention to provide an improved eyelash curler in which the above disadvantages are overcome.

In one aspect, the present invention is proposed to provide an eyelash curler including a gripping body; a bifurcate supporting member secured on the gripping body by means of a fitting member; an operation handle pivotally held at its intermediate portion between the tine of the bifurcate supporting member and having an outer end trigger-like hoop portion; a pair of follower rods each lower end of which is pivotally held on the inner end of the operation handle; a holder slidable up and down along the vertical parallel rod portions of the supporting member by means of the follower rods whose upper ends are secured thereto in spaced relation with each other; a lower nipping member mounted on the holder, and an upper nipping member both ends of which are secured to the upper portion of the supporting member; the holder, the low nipping member and the upper nipping member all being moderately curved outward substantially in conformity with the curvature of the eyelids as that the upper and lower nipping members may be mated with each other when the latter is pushed up by pulling down the trigger-like hoop portion, thereby allowing the eyelash to be curled; characterized in that the gripping body contains a high-low adjustable electric heater and blower device and that a flexible tube is provided for supplying hot air from the blower to a nozzle member for the upper nipping member.

For a further understanding of the present invention and for features and advantages thereof, reference may be made to the following description and the drawings which illustrate preferred embodiments of eyelash curlers in accordance with the present invention.

DESCRIPTION OF THE PREFERRED EMBODIMENTS

Figure 1:
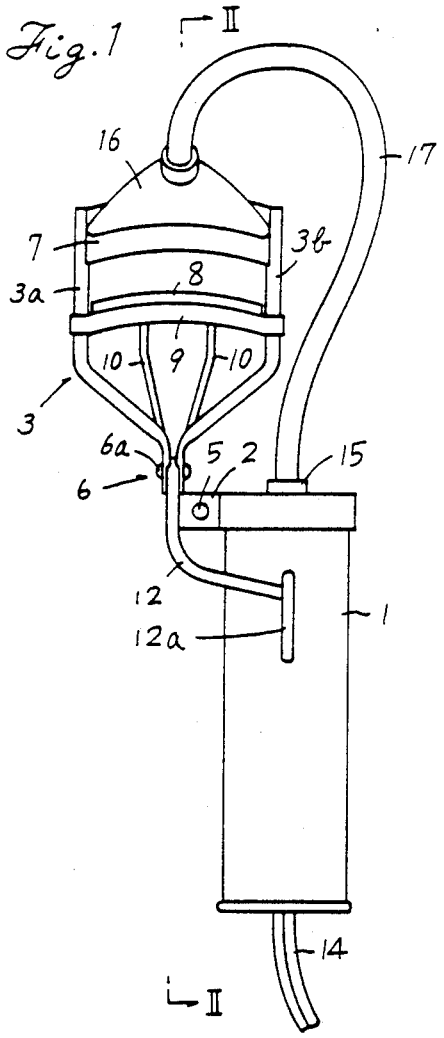
FIG. 1 is a front view of an embodiment of the eyelash curler according to the invention.
Figure 2:
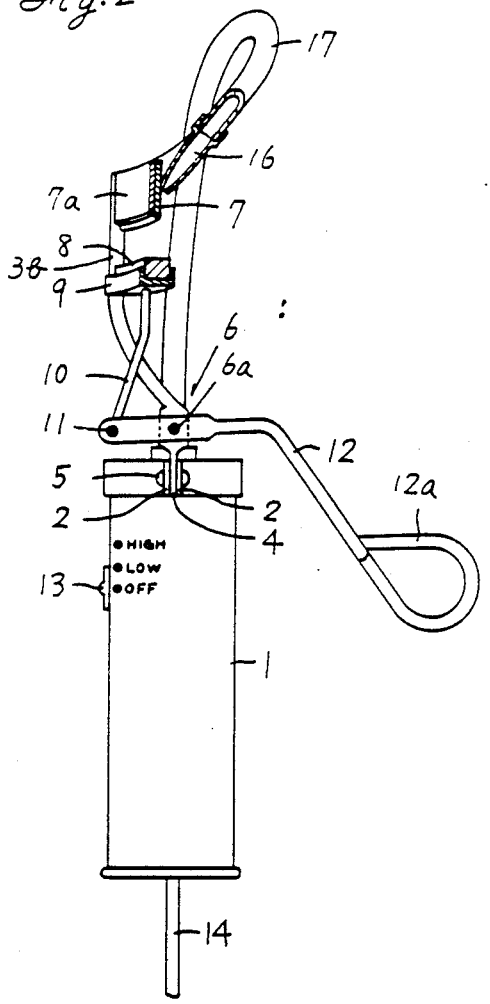
FIG. 2 is a side view partly in section taken along the line II—II of FIG. 1.
Figure 10:
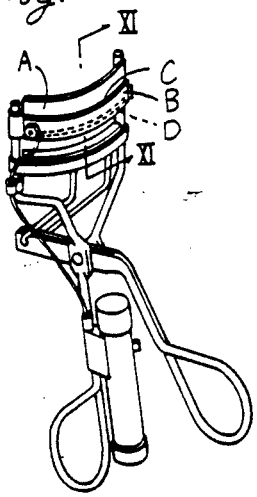
FIG. 10 is a perspective view of an example of eyelash curlers of prior art.
Figure 11:
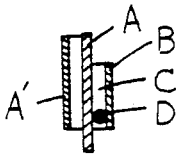
FIG. 11 is a vertical sectional view taken along the line XI—XI of FIG. 10.

Referring now to the drawings, particularly to FIGS. 1,2 which illustrate in detail an embodyment of the present invention, a cylindrical, hollow gripping body 1 of an eyelash curler has a fitting member 2 wound around the top of the gripping body and fastened at both ends extending sideward by a pin 5 together with the lower end 4 of a supporting member 3 placed therebetween. The fitting member 2 may be a bifurcate one fixed on any side of the top which is closed except for an outlet 15. The gripping body contains a high-low adgustable electric heater and blower device (not shown), there being illustrated only a slide switch 13 and a power cable 14. The supporting member 3 comprises bifurcated rods which extend, past through-hole portions 6, first slopewise and then vertically upward to define vertical rod portions 3*a*, 3*b* in parallel in the same manner as in the prior art construction of FIG. 10.

An upper nipping member 7 for eyelash curling purpose and made of heat conductive metallic strap with appropriate thickness is fixed on both top ends of the vertical rod portions 3*a*, 3*b*. On the inner face of the upper nipping member 7 is sticked a heat shielding tape 7*a*. The lower end of the upper nipping member 7 is preferably round shaped so that the eyelash may be softly nipped.

Figure 9:
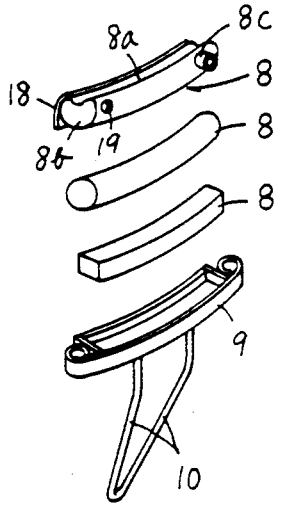
FIG. 9 is a perspective view showing various type of lower nipper members and a nipper holder.

Spanning both vertical rod portions 3*a*, 3*b* and bellow the upper nipping member 7, a sliding holder 9 for holding a lower nipping member 8 is put on the rod portions 3*a*, 3*b* slidably therealong. For this purpose, the sliding holder 9 has both ends provided with collar as shown at bottom in FIG. 9 or other suitable means for slidalle receiving of the rod portions 3*a*, 3*b*. The lower nipping member 8 is made of an elastic rubber material which allows soft receiving of the eyelash. It is of cross-sectionally rectangular shape wider than the thickness of the upper nipping member 7 and is slightly shorter in length than the distance between the rod portions 3*a*, 3*b*. The above crosssectionally rectangular shape may of course be altered to circular or other shapes as shown in FIG. 9.

The sliding holder 9 is connected at intermediate portion thereof to the upper ends of follower rods 10, 10 in spaced relation with each other. The lower ends of the follower rods 10, 10 are pivotaly connected through a pin 11 to the inner end of an operation handle 12 which has an outer end trigger-like hoop portion 12*a*. The operation handle 12 is pivottaly held at this intermediate portion by a pin 6*a*.

As already described, the gripping body 1 contains the high-low adjustable electric heater and blower device, and the device is so designed to produce hot air of high and low level, say about 40 and 60 degrees C., by operating the slide switch 13 accordingly. From the outlet 15 on the top of the gripping body 1, a flexible tube 17 for hot air supplying purpose extends to a nozzle member 16 for the upper nipping member 7. The nozzle member 16 is secured on top of the upper nipping member 7 and is formed in such downward flared configuration that allows hot air to be evenly distributed to the outer surface of the upper nipping member 7. In other words, the lower ends of the nozzle member 16 is downward flared out and the outer edge thereof is curved substantially in conformity with the curvature of the upper nipping member 7, so that the hot air from the flexible tube 17 can be evenly distributed all over the outer surface of the upper nipping member 7.

By the way, it is a matter of course that the upper and lower nipping member 7, 8 and the sliding holder 9 are all moderately curved outward substantially in conformity with the average curvature of eyelids.

Figure 5:
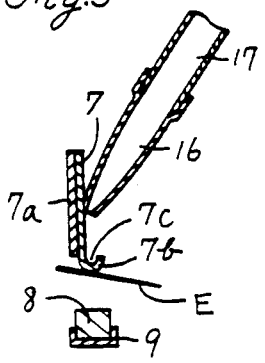
FIG. 5 is a similar view to FIGS. 4*a*–4*c*, showing a second embodiment of the invention.

Turing to FIG. 5 which illustrates a second embodiment of the present invention, the upper nipping member 7 is bent up outward preferably in round shape at the lower end thereof to provide a bent edge 7*b* so that there may be defined a hot air accumulation area 7*c* for accelrating the heat conduction by the lower end portion and the bent edge 7*b*.

Figure 7:
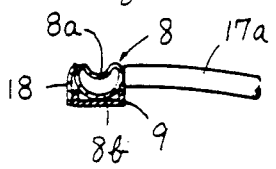
FIG. 7 is a vertical sectional view taken along the line VII—VII of FIG. 6.
Figure 6:
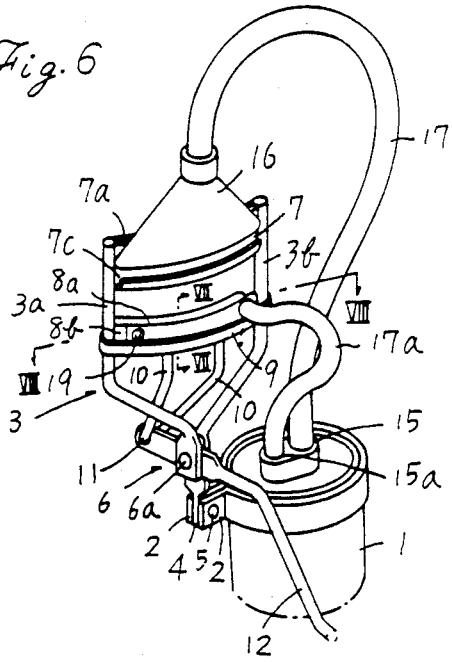
FIG. 6 is a perspective view of a third embodiment of the invention.
Figure 8:
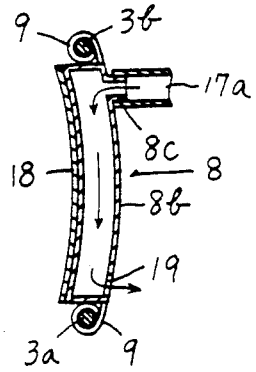
(Prior Art) Fig. 8
FIG. 8 is a cross-sectional view taken along the line VIII—VIII of FIG. 6.

Further referring to FIGS. 6–8, there is illustrated in detail a third embodiment of the present invention.

A glance at FIG. 7 shows that there is formed another output 15*a* on the top of the gripping body 1 and another flexible tube 17*a* also extends from the blower to a diferrent type of lower nipping member 8 which is illustrated in detail in FIGS. 7, 8. This nipping member 8 comprises a both end closed hollow tube 8*b* made of a heat conductive metallic material in place of the elastic rubber material hereinbefore described and a heat shielding member 18 fixed on inner side thereof. As shown in FIG. 7, the hollow tube 8*b* has a roundly recessed upper face 8*a* being a configuration substantially in conformity with the roundness of the lower end of the upper nipping member 7 so that the roundly recessed upper face 8*a* may fit with the latter; it should be noted that there is employed the upper nipping member 7 of the type shown in FIG. 5 which has the heat accumulation area 7*c*. The hollow tube 8*b* has an outer side an inlet 8*c* near one end and an outlet 19 near the other end as clearly seen in FIG. 8. The second flexible tube 17*a* is of course connected to the above inlet 8*c*. With this embodiment, hot air generated in the gripping body 1 is supplyed through the flexible tubes 17, 17a to the upper and lower nipping members 7, 8 which in turn are evenly heated all around due to their heat conductivity.

Figure 4A:
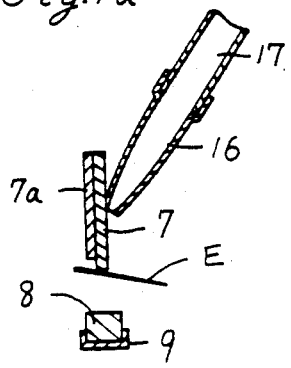
FIG. 4*a*, 4*b*, and 4*c* are enlarged illustrative fragmentary views in section of an upper portion of the eyelash curler of FIG. 1, respectively showing steps of curling.
Figure 4B:
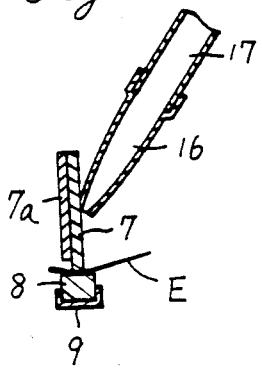
Figure 4C:
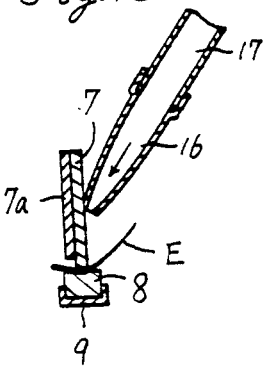
Figure 3:
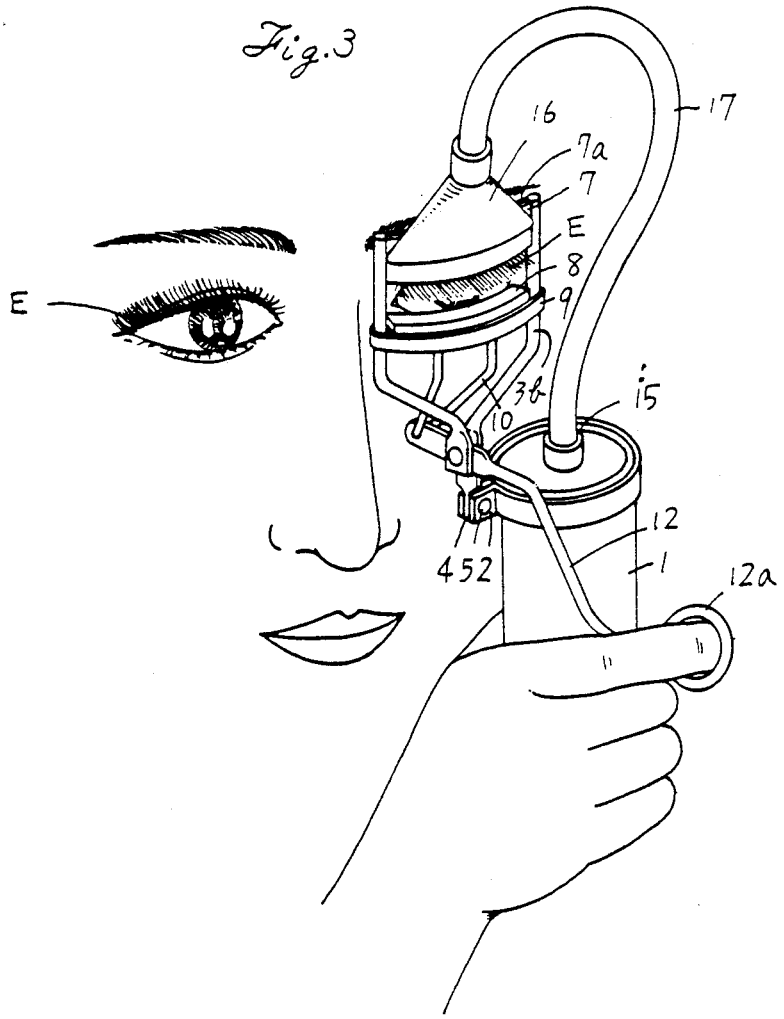
FIG. 3 is an illustrative perspective view showing the use of the eyelash curler of FIG. 1.

In use, when a woman who desires for her eyelash E to be curled upward for beauty treatment, as shown in FIG. 3, a fore finger for example is put into the trigger-like hoop 12*a* of the operation handle 12 while holding the gripping body 1 and putting the lower end of the upper nipping member 7 on the upper face the eyelash E as shown in FIG. 4*a*, and then the hoop 12*a* is pulled inward to move up the sliding holder 9 and the lower nipping member 8. After nipping the eyelash E between the upper and lower nipping members 7, 8 as shown in FIG. 4*b*, the slide switch 13 is operated to drive the heater and blower device which supplies hot air of either high or low level to the upper nipping member 7 through the flexible tube 17 in the cases of the first and second embodiments. And, in case of the third embodiment, hot air is also supplied to the lower nipping member 8 through the flexible tube 17*a*. The eyelash E is thus curled upward by and between the upper and lower nipping members 7, 8 in such manner as described below.

In case of the first and second embodiment, the lower end of the upper nipping member 7 intrudes on the lower nipping member 8 which is per se elastic and there can be formed a roundly recessed fit between both nipping members 7, 8, while, in case of the third embodiment, the shapes of the lower end of the upper nipping member 7 and the upper face of the lower nipping member 8 are originally designed to give the above desired roundly recessed fit, and thus in either case, the eyelash E can be heat curled upward in accordance with the round recessed configuration.

After completion of the curling, the hoop 12*a* of the operation handle 12 is pushed outward to move down the sliding holder 9 together with the lower nipping member 8 and the slide switch 13 is also returned to OFF.

Constructed as above, the heat shield tape 7*a* sticked on the inner side of the upper nipping member 7 and the heat shielding member 18 fixed on the inner side of the lower nipping member 8 not only securely prevent heat supplied to the nipping members 7, 8 from irritating or burning user's face but also convey moderate warmth thereto. The adjustable heater and blower device contained in the gripping body 1 can supply such hot air as being optimum temperature of high and low levels according to user's choice. This enables both hard and soft eyelashs to be satisfactorily curled without danger of returing to original uncurled state.

What is claimed is:

1. An eyelash curler including a gripping body; a bifurcate supporting member secured on the gripping body by means of a fitting member; an operation handle pivotally held at its intermediate portion between the tine of the bifurcate supporting member and having an outer end trigger-like hoop portion; a pair of follower rods each lower end of which is pivotally held on the inner end of the operation handle; a holder slidable up and down along the vertical parallel rod portions of the supporting member by means of the followers rods whose upper ends are secured thereto in spaced relation with each other; a lower nipping member mounted on the holder, and an upper nipping member both ends of which are secured to the upper portion of the supporting member; the holder, the lower nipping member and the upper nipping member all being moderately curved outward substantially in conformity with the curvature of the eyelids as that the upper and lower nipping members may be mated with each other when the latter is pushed up by pulling down the trigger-like hoop portion, thereby allowing the eyelash to be curled; characterized in that the gripping body contains a high-low adjustable electric heater and blower device at least one flexible tube is provided for supplying hot air from the blower device to at least one of the lower and the upper nipping member and distribution means is provided for uniformly distributing the hot air over the respective nipping member.

2. An eyelash curler in accordance with claim 1 wherein said upper nipping member is a strap made of heat conductive metallic material to which the hot air is applied.

3. An eyelash curler in accordance with claim 1 wherein said upper nipping member is provided on the outer side with lower extention bent upward so that a hot air accumulation area may be defined by the lower end and the bent edge.

4. An eyelash curler in accordance with claim 1 wherein the distribution means comprises a nozzle member of downward flared configuration and suitable for receiving the upper end of the flexible tube and fixed over the length of the upper nipping member so that hot air may be evenly distributed to an outer surface of the upper nipping member.

5. An eyelash curler in accordance with claims 1 wherein said upper nipping member has a heat shielding tape stuck on all over the inner surface thereof.

6. An eyelash curler in accordance with claim 1 wherein said lower nipping member is formed of elastic rubber of a cross-sectionally rectangular shape wider than the thickness of the upper nipping member.

7. An eyelash curler in accordance with claim 1 wherein said lower nipping member is formed of elastic rubber of cross-sectionally circular shape wider than the thickness of the upper nipping member.

8. An eyelash curler in accordance with claim 4 wherein said lower nipping member comprises a heat conductive metallic hollow tubular body whose upper face is such recessed over the length that provides suitable mating with the lower end of the upper nipping member, said tubular body being closed at both ends and provided with an inlet near to one end and an outlet near to the other end respectively for receiving and exhausting hot air, and said gripping body being provided with another flexible rubber tube through which hot air is supplied also to the inlet of the tubular body.

9. An eyelash curler in accordance with claim 1 wherein said lower nipping member is provided on inner side thereof with a heat shielding member.

* * * * *